United States Patent [19]

Green

[11] 4,312,393

[45] Jan. 26, 1982

[54] COUPON ORGANIZER

[76] Inventor: Richard L. Green, 7300 South Wabash, Chicago, Ill. 60611

[21] Appl. No.: 123,363

[22] Filed: Feb. 21, 1980

[51] Int. Cl.[3] ..... A45C 11/18

[52] U.S. Cl. ..... 150/39; 40/124.2; 206/425

[58] Field of Search ..... 206/425; 150/39; 16/DIG. 13; 40/124.2

[56] References Cited

U.S. PATENT DOCUMENTS

| | | | |
|---|---|---|---|
| 2,647,071 | 7/1953 | Schade | 150/39 X |
| 2,788,041 | 4/1957 | Carver | 150/39 |
| 3,227,471 | 1/1966 | Coniker | 150/39 X |
| 3,392,771 | 7/1968 | Hartley | 150/39 |
| 3,777,795 | 12/1973 | Graetz | 150/39 X |
| 4,004,690 | 1/1977 | Giarritta | 150/39 X |
| 4,068,889 | 1/1978 | Pierce | 16/DIG. 13 |

*Primary Examiner*—Donald F. Norton
*Attorney, Agent, or Firm*—Gerald S. Geren

[57] ABSTRACT

There is disclosed herein a book-like coupon organizer for carrying and arranging various types and size cents-off coupons and refund offers, by designated product categories. The organizer includes front and back panels which are hingedly connected and a plurality of coupon-receiving pockets on the inner surface of said panels, said pockets extending transversely to said hinge connecting said panels. The panels are formed of rigid panel-forming members arranged in spaced edge-to-edge relation and heat-sealable inner and outer plastic sheets. Step-folded pocket-forming sheets and the inner and outer sheets are heat-sealed together so as to encase the panel-forming members as well as forming the hinge.

6 Claims, 5 Drawing Figures

FIG. 1
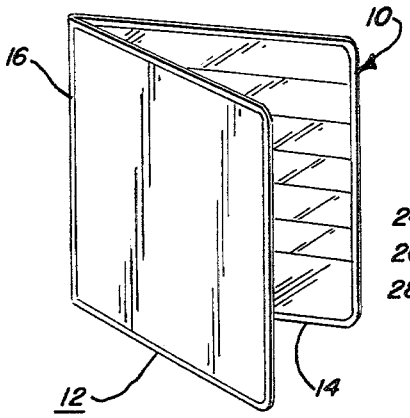
FIG. 2
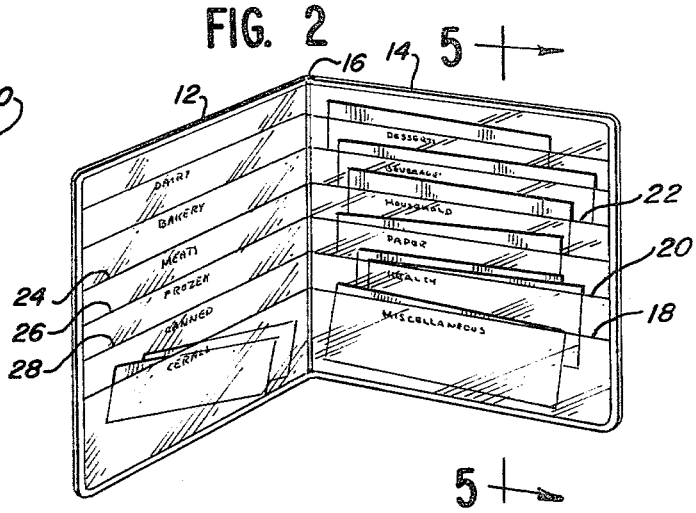
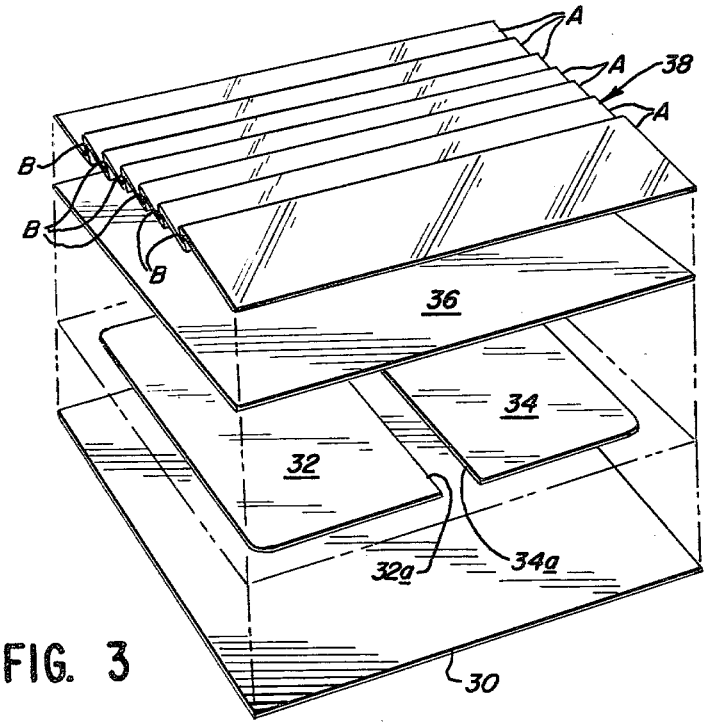
FIG. 3
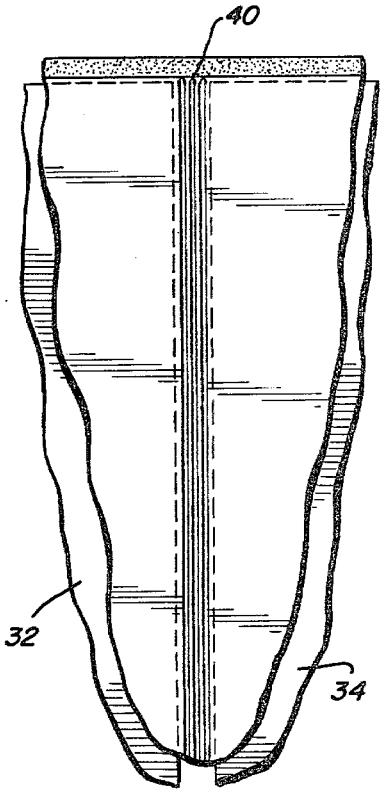
FIG. 4
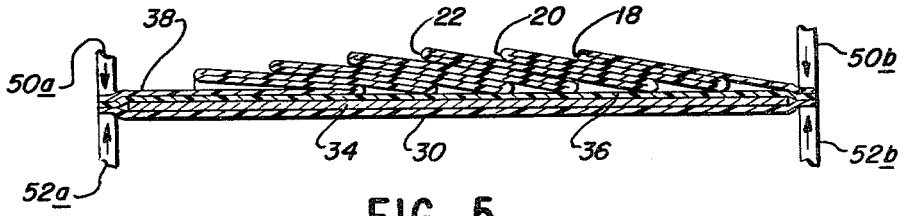
FIG. 5

COUPON ORGANIZER

BACKGROUND OF THE INVENTION

This invention relates to an organizing device, and more specifically, to a multi-coupon organizer.

Food and drug retailers, manufacturers and distributors offer coupons and refund offers to stimulate sales and repeat purchases, on given products, with the consuming public. Saving-conscious consumers clip and save these coupons and/or refund offers for subsequent redemption (use) and/or refund. Coupons have become a major marketing tool, and for 1979 it is estimated that over 80 billion coupons were distributed.

It is therefore desirable that shoppers have a systematic, functional device for organizing and storing coupons until such time they are put to use. Having said device would, in fact, encourage greater coupon utilization and savings on the part of consumers.

It is also desirable for manufacturers, distributors, and retailers to provide said organizing device as a premium product to their customers, thereby enhancing the utilization of coupons and increasing the sales of coupon products.

There exists many different types of wallets, specifically devised, for carrying paper money, credit cards, pictures, and the like. Such wallets and devices are shown in the following U.S. Pat. Nos.: 1,683,996; 2,634,777; 2,732,874; 2,909,202; 3,067,792; 3,187,795; 3,227,471; 3,392,771; 3,435,969; 3,483,909; 3,565,148; 3,659,640; 3,759,305; 3,777,795; 3,845,800; 3,858,790; 3,946,781; 3,994,328; 4,008,742; and 4,101,787. Some of these devices may also be used to contain coupons. However, none of these devices have been specifically designed as coupon organizers, nor are they suitable due to size, shape and/or cost of manufacturing.

It is therefore the object of this invention to provide a coupon organizer which will be functional, desirable for use, and readily manufactured.

These and other objects will become apparent from the following description and appended claims.

SUMMARY OF THE INVENTION

There is provided by this invention a coupon organizer which can be readily manufactured, and is functional, attractive and desirable from the consumer, retailer, manufacturer, and distributor point of view. Also this coupon organizer differs by size, shape, design and/or cost of manufacturing, from any device presently being used for the purpose of organizing coupons.

The organizer includes rigid front and back panel-forming members which are encased between two heat-sealable plastic sheets so as to form front and back panels which may be folded upon one another. A pocket-forming plastic sheet is provided and step-folded so as to define an elongated pocket for receiving the coupons.

The coupon organizer is approximately 8½ inches long and 7 inches wide with each pocket being approximately 6¾ inches long and ¾ inches wide. This has been found to be a very suitable arrangement since it permits the coupons to be stored in a flat, neatly filed condition.

BRIEF DESCRIPTION OF THE DRAWINGS

FIG. 1 is a perspective view showing the assembled organizer in a partially open condition;

FIG. 2 is a perspective view showing the organizer in the open condition and showing the coupons in place;

FIG. 3 is an exploded perspective view showing the elements of the organizer in position for assembly;

FIG. 4 is a plan view showing a portion of a hinge connection between the front and back panels of the organizer; and FIG. 5 is a sectional view taken along line 5—5 of FIG. 2 and showing the step-folded coupon-receiving pockets.

DESCRIPTION OF THE PREFERRED EMBODIMENT

Referring now to FIG. 1, a coupon organizer 10 generally is shown. The organizer is a book-like device having a front panel 12 and a back panel 14 which are connected to one another along an integral hinge structure 16.

The outside surfaces of the front and back panels 12 and 14 can be decorated so as to provide advertising, indicia, etc. The inside of the organizer includes a plurality of elongated coupon-receiving pockets, such as 18, 20, 22, 24, 26 and 28, which extend from one side edge of the organizer to the other and transverse to the hinge construction.

The organizer is 8⅜ inches long (i.e., from top-to-bottom) and 6 7/8 inches wide (i.e., side-to-side). Each of the pockets are approximately 6 7/8 inches wide and approximately 2 7/16 inches deep.

These dimensions have been selected so as to permit the flat storage of most coupons.

As can be seen, the device includes twelve pockets, and each of said pockets are provided with indicia indicating the type of coupon to be stored therein. Said indicia is set forth in the following table and is arranged in the same manner on the organizer:

| Indicia | Indicia |
|---|---|
| Dairy Products | Desserts/Garnishes/Condiments |
| Bakery Products/Supplies | Beverages |
| Meats | Household/Cleaning Supplies |
| Frozen Foods | Paper/Film/Foil |
| Canned Foods | Health and Beauty Aids |
| Cereals/Dry Foods | Shopping List/Misc. Coupons |

The structure of the assembly and method of manufacturing is more readily seen in FIG. 3.

In FIG. 3, there is shown an outer heat-sealable plastic cover sheet 30. A pair or rigid panel-forming members 32 and 34 are provided and are positioned on the outer sheet 30 and in spaced edge-to-edge relationship. As can be seen, the area of both panels 32 and 34 is less than the area of the sheet 30 so that a margin is provided about the peripheral edge of the panels and so that there is a space between the inner edges 32*a* and 34*a* of the panels.

The inner heat-sealable plastic sheet 36, of the same size as the outer sheet 30, is positioned over the rigid panel-forming members 32 and 34.

A step-folded, transparent, heat-sealable, pocket-forming plastic sheet 38 is placed on the inner sheet 36.

The plastic sheet 38 has been step-folded in such a manner so as to have the two basic fold dimensions. In FIG. 3, the first series of long or top folds is indicated by the letter "A" and the series of second shorter or lower folds is indicated by the letter "B". The first fold "A" is 3 7/16 inches from the bottom edge to the top edge and the second or return fold "B" is 2 7/16 inches. In order to provide the twelve pockets as shown, a sheet which is $14\frac{1}{8}$ inches wide and $37\frac{3}{4}$ inches long has been folded to provide the sheet 38.

In order to assemble this organizer, the pocket-forming sheet 38 and the inner and outer cover sheets 36 and 30 are heat-sealed together about their peripheral edges and between the step's inner edges of the panel-forming members 32 and 34. By heat-sealing around the edges, the sheets are secured together and the panel-forming members are encased within the plastic sheets. The heat-seal between the edges, which is approximately $\frac{1}{4}$-inch wide and which provides three ribs as shown in FIG. 4, provides the hinge for the coupon organizer.

FIG. 5 shows upper and lower heat-seal dies 50*a* and 52*a* and 52*b* respectively, engaging the periphery of the inner and outer sheets 34 and 36 and of the pocket-forming sheet 38 so as to heat-seal those sheets together along the outer edges of the organizer 10. The peripheral seal on the finished organizer is seen in FIGS. 1 and 2.

The foregoing structure and method of manufacturing provides a commercially desirable coupon organizer.

It will be appreciated that numerous changes and modifications can be made to the embodiment shown herein without departing from the spirit and scope of the invention.

What is claimed and desired to be secured by Letters Patent of the United States is:

1. A book-like coupon organizer for carrying and arranging coupons, said organizer including front and back panels, said front and back panels hingedly connected to each other for opening and closing said organizer, and a plurality of coupon-receiving pockets provided on the interior face of said panels, said pockets extending transversely to said hinge connecting said panels, and said pockets sized and shaped to receive unfolded coupons therein, said organizer comprising:

rigid front and back panel-forming members arranged in spaced edge-to-edge relation;

heat-sealable inner and outer plastic cover sheets for encasing said front and back panel-forming members therebetween and for forming said hinge connection between the front and back panel-forming members;

pocket-forming plastic sheet means positioned and heat-sealed upon the face of one of said plastic cover sheets, said pocket-forming sheet means repeatedly folded back on itself in a stepped fashion to form a plurality of coupon-receiving pockets;

said cover sheets and said pocket-forming sheet being sealed to each other (a) about the periphery thereof so as to encase said panel-forming members between said inner and outer cover sheets and (b) between the spaced edges of said panel-forming members so as to form said hinge between said front and back panels and to separately encase each of said panel-forming members, thereby forming the front and back panels with coupon-receiving pockets on the interior faces thereof, said pockets extending fron one side edge of the front and back panels to the other and transverse to said hinge.

2. A coupon organizer as in claim 1, wherein the pocket-forming sheet is transparent and indicia depicting the product category is printed atop each coupon-receiving pocket to identify the category of coupon to be placed therein.

3. A coupon organizer as in claim 1, wherein the cover sheets and the pocket-forming sheet means are heat-sealed to each other, the hinge between the panel-forming members including a plurality of ribs to facilitate folding therealong.

4. A coupon organizer as in claim 3, wherein the hinge comprises, three elongated ribs formed by heat-sealing said cover sheets and said pocket-forming sheet means.

5. A coupon organizer as in claim 1, wherein each of said coupon-receiving pockets include a coupon access opening extending transversely to said hinge.

6. A book-like coupon organizer for carrying and arranging coupons, said organizer including front and back panels, said front and back panels hingedly connected to each other for opening and closing said organizer, and a plurality of coupon-receiving pockets provided on the interior face of said panels, and said pockets sized and shaped to receive unfolded coupons therein, said organizer comprising:

rigid front and back panel-forming members arranged in spaced edge-to-edge relation;

heat-sealable inner and outer plastic cover sheets for encasing said front and back panel-forming members therebetween and for forming said hinge connection between the front and back panel-forming members;

pocket-forming plastic sheet means positioned and heat-sealed upon the face of one of said plastic cover sheets, said pocket-forming sheet means repeatedly folded back on itself in a stepped fashion to form a plurality of coupon-receiving pockets;

said cover sheets and said pocket-forming sheet being sealed to each other (a) about the periphery thereof so as to encase said panel-forming members between said inner and outer cover sheets and (b) between the spaced edges of said panel-forming members so as to form said hinge connection between said front and back panels and to separately encase each of said panel-forming members, thereby forming the front and back panels with coupon-receiving pockets on the interior faces thereof.

* * * * *